US008299977B2

(12) United States Patent
Hsu

(10) Patent No.: US 8,299,977 B2
(45) Date of Patent: Oct. 30, 2012

(54) SHOCK- AND MOISTURE-RESISTANT CONNECTOR ASSEMBLY

(75) Inventor: Chin-Teng Hsu, Yungkang (TW)

(73) Assignee: Lih Yeu Seng Industries Co., Ltd., Yungkang, Tainan County (TW)

( * ) Notice: Subject to any disclaimer, the term of this patent is extended or adjusted under 35 U.S.C. 154(b) by 479 days.

(21) Appl. No.: 12/720,071

(22) Filed: Mar. 9, 2010

(65) Prior Publication Data

US 2011/0221654 A1 Sep. 15, 2011

(51) Int. Cl.
*H01Q 1/50* (2006.01)

(52) U.S. Cl. ..... 343/906; 343/901; 343/791; 439/345

(58) Field of Classification Search ..... 343/906, 343/901, 702, 791; 439/345
See application file for complete search history.

(56) References Cited

U.S. PATENT DOCUMENTS

| | | | | |
|---|---|---|---|---|
| 6,808,407 | B1 * | 10/2004 | Cannon | 439/314 |
| 7,079,087 | B2 * | 7/2006 | Bateman et al. | 343/906 |
| 7,466,288 | B2 * | 12/2008 | Huang | 343/906 |
| 2007/0205960 | A1 * | 9/2007 | Fujikawa et al. | 343/906 |

* cited by examiner

*Primary Examiner* — Dieu H Duong
(74) *Attorney, Agent, or Firm* — Alan Kamrath; Kamrath IP Lawfirm, PA

(57) ABSTRACT

A shock- and moisture-resistant connector assembly includes a first component, a second component, and an antenna. The first component has an end fitted with an adapter. A non-annular fastener is mounted around a connecting section of the adapter for tightly fastening the second component inserted in the first component. The second component is provided therein with at least one watertight O-ring which, after the first and second components are assembled, furnishes moisture and shock resistance to a coaxial cable passing through the second component. The antenna includes a dielectric spacer externally mounted with a coupling element and having an end formed as a shaft. A plastic washer, a wave washer, and a positioning washer are sequentially mounted around the shaft such that the entire assembled antenna has sufficient frictional resistance to maintain restrained displacement during a fine-tuning operation.

4 Claims, 13 Drawing Sheets

SHOCK- AND MOISTURE-RESISTANT CONNECTOR ASSEMBLY

BACKGROUND OF THE INVENTION

1. Technical Field

The present invention relates to a shock- and moisture-resistant connector assembly. More particularly, the present invention relates to a shock- and moisture-resistant connector assembly which is configured for signal relay and transmission in wideband wireless communication and is applicable to cars, television sets, base stations, and so on which are subject to external shock and moisture.

2. Description of Related Art

Presently, connectors intended for signal relay and transmission and designed specifically for cars, television sets, base stations, and so on which are open to shock and moisture are available in various configurations. Such a connector typically includes a main body at a butt end and a terminal at a connecting end. When the two components are assembled, the intended signal connection is attained.

BRIEF SUMMARY OF THE INVENTION

The present invention provides a novel configuration of connector assemblies which are designed for signal relay and transmission and applicable to cars, television sets, base stations, and so on which are subject to shock and moisture. It is hoped that the connector assembly disclosed herein provides not only signal relay and transmission in wideband wireless communication but also high resistance to shock and moisture.

It is a primary object of the present invention to provide a connector assembly applicable to cars, television sets, base stations, and so on which are subject to external shock and moisture, wherein the connector assembly includes a first component, a second component, and an antenna. The first component has an end fitted with an adapter. The adapter has a connecting section encircled by a non-annular fastener. The non-annular fastener has two ends which jointly form an opening and are each formed with a loop. The two loops, for example, are axially and radially oriented, respectively. By pulling the two loops outward away from each other, the non-annular fastener is pulled open and has an increased outer diameter which allows the non-annular fastener to be mounted around the connecting section of the adapter at the end of the first component. After the connecting section of the adapter is coupled with the second component, the two loops of the non-annular fastener, which now encircles a border portion between the first and second components, are twisted around each other to provide secure fastening without using additional tools. The second component includes an inner copper tube through which a coaxial cable passes, and at least one watertight O-ring is mounted around an outer periphery of a predetermined section of the inner copper tube. In addition, an annular recess is concavely and peripherally provided at an outer end of the inner copper tube such that a connecting element fitted around an outer surface of the inner copper tube can be pressed inward against the annular recess of the inner copper tube at a position corresponding to the annular recess, so as for the second component to provide moisture resistance to the coaxial cable penetrating the second component. The dielectric spacer includes a pressing ring which, together with a plastic jacket of the coaxial cable, provides further moisture resistance. Thus, after the second component is inserted in the adapter at the end of the first component, and the loops of the non-annular fastener at the end of the first component are twisted around each other, resistance to moisture and shock is enabled between the first and second components. Besides, the loops of the non-annular fastener can be fixed or attached, by a screw passing through the loops, to a car, a television set, a base station, and so on which are subject to shock and moisture.

It is a secondary object of the present invention to provide a connector assembly applicable to cars, television sets, base stations, and so on which are open to shock and moisture, wherein the connector assembly includes a first component, a second component, and an antenna, and wherein the antenna includes a dielectric spacer externally fitted with a coupling element and having an end formed as a shaft through which a plastic washer, a wave washer, and a positioning washer are sequentially mounted. The wave washer sandwiched between the plastic washer and the positioning washer has opposite surfaces alternately formed with a plurality of projections such that the projections on each of the opposite surfaces of the wave washer provide frictional resistance against a contact surface of the adjacent plastic washer or of the adjacent positioning washer, thereby tightly restraining displacement of the entire assembled antenna during a fine-tuning operation. Moreover, the dielectric spacer of the antenna through which the coaxial cable passes has an inner section formed as an embossed connecting rod section. The connecting rod section is provided with at least one chamfered flange for restraining the antenna when the dielectric spacer is connected to the antenna.

BRIEF DESCRIPTION OF THE SEVERAL VIEWS OF THE DRAWINGS

The invention as well as a preferred mode of use, further objects, and advantages thereof will be best understood by referring to the following detailed description of an illustrative embodiment in conjunction with the accompanying drawings, in which.

DETAILED DESCRIPTION OF THE INVENTION

Figure 15:
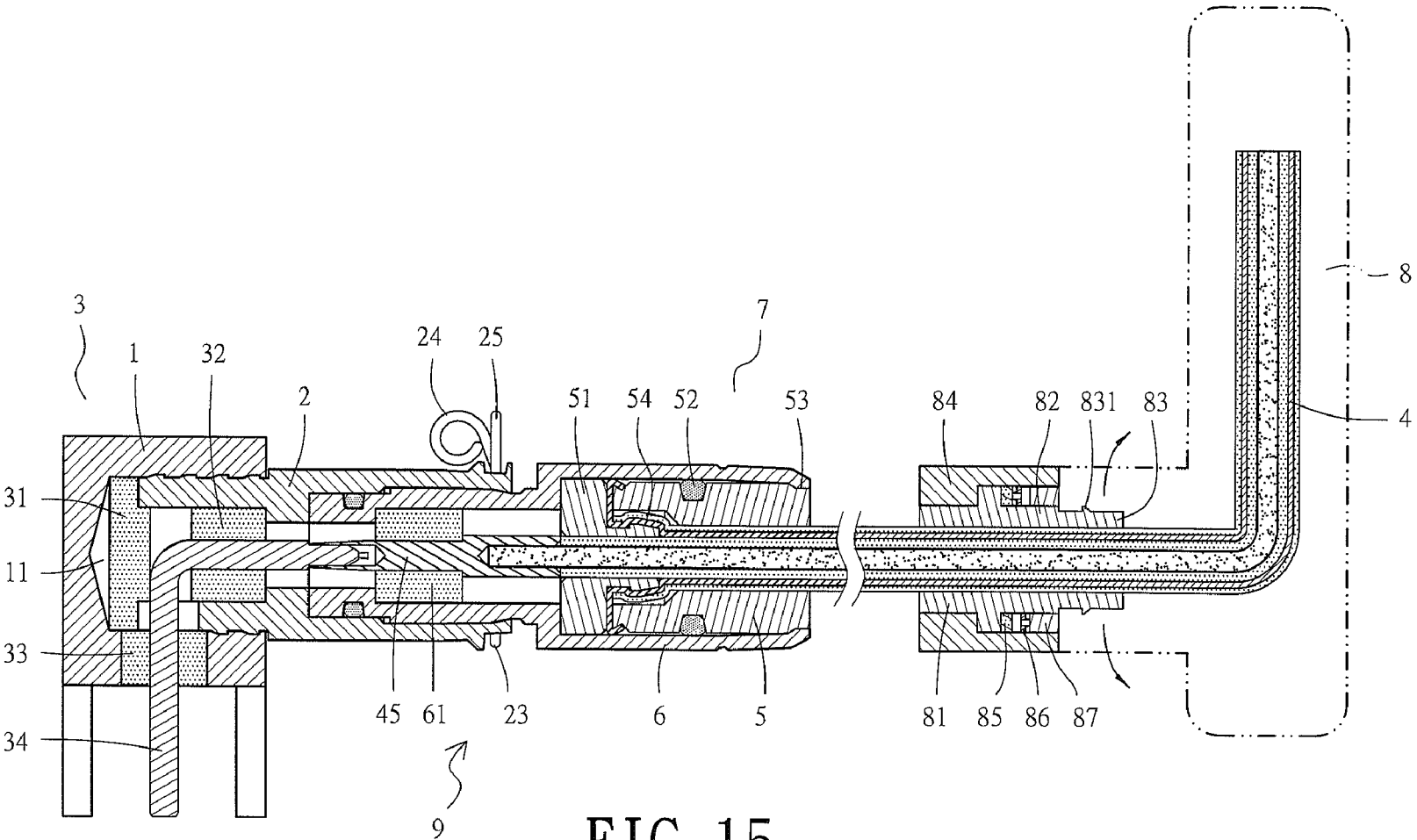
FIG. 15 is a front sectional view of a connector assembly according to the present invention.
Figure 16:
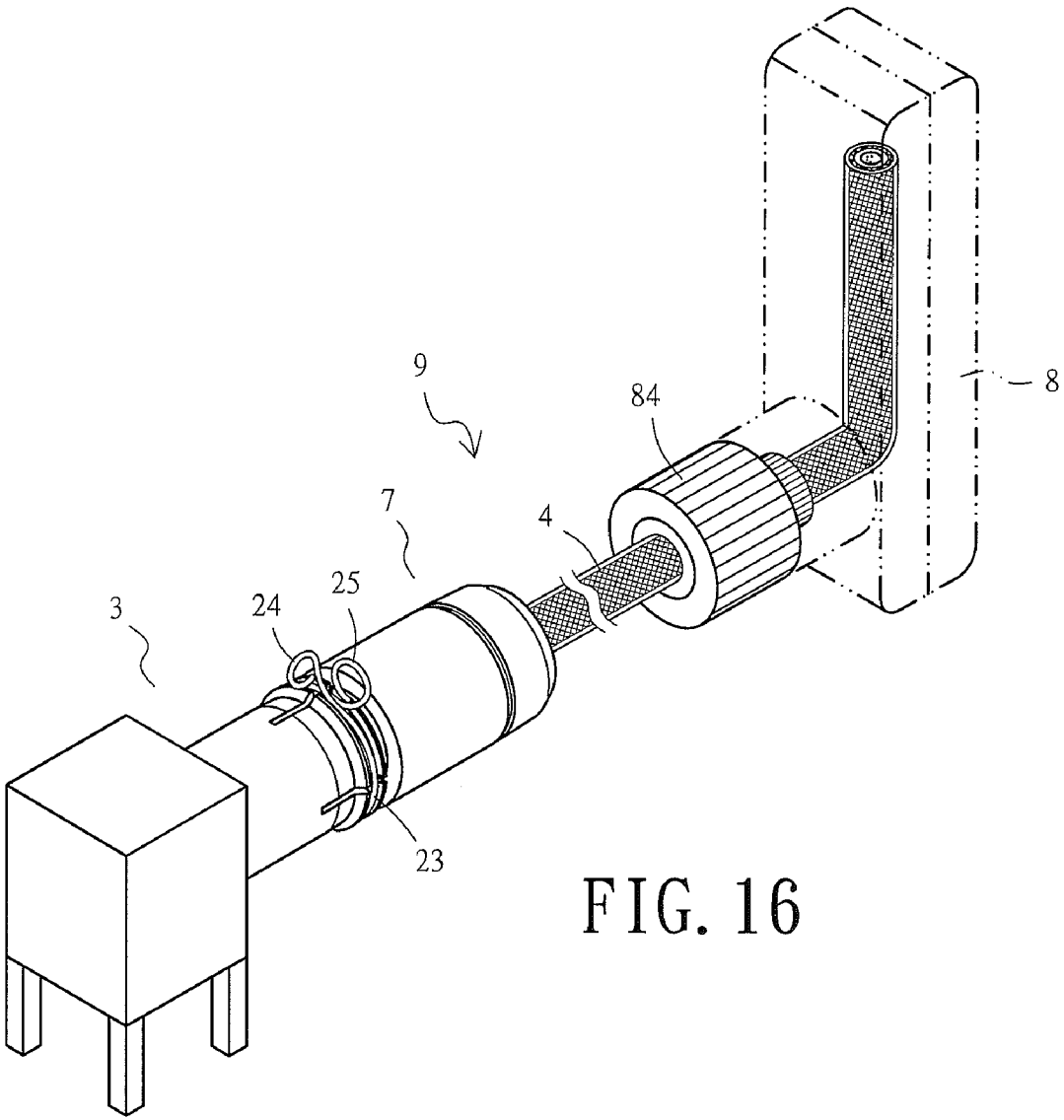
FIG. 16 is a perspective view of the connector assembly according to the present invention.

Referring to FIG. 15 and FIG. 16, a shock- and moisture-resistant connector assembly 9 according to the present invention is for use in a car and includes a first component 3, a second component 7, and an antenna 8.

Figure 8B:
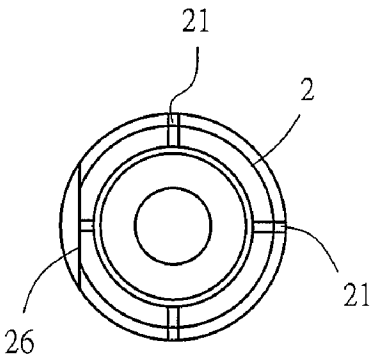
FIG. 8B is a side view of the adapter shown in FIG. 8A.
Figure 8C:
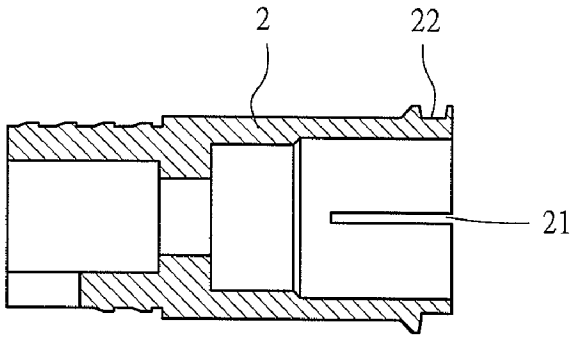
FIG. 8C is a sectional view taken along line 80-80 of FIG. 8A.
Figure 8A:
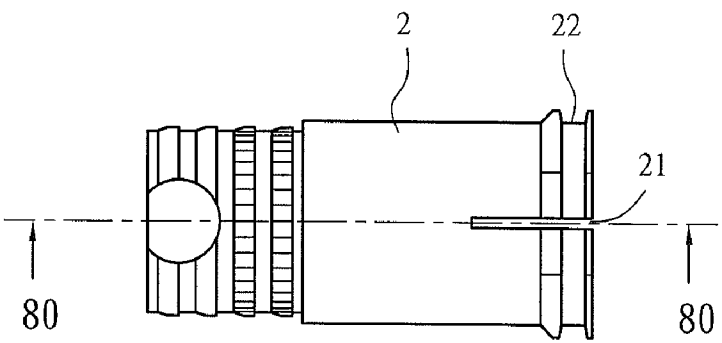
FIG. 8A schematically shows an adapter of a first component according to the present invention.
Figure 9B:
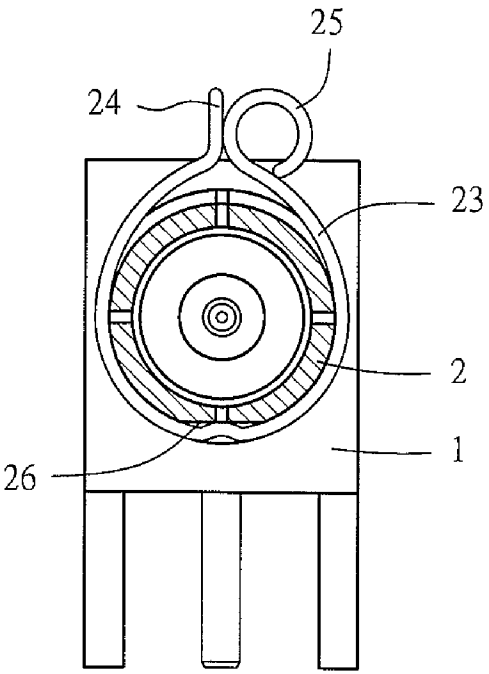
FIG. 9B is a sectional view taken along line 90-90 of FIG. 9A.
Figure 9A:
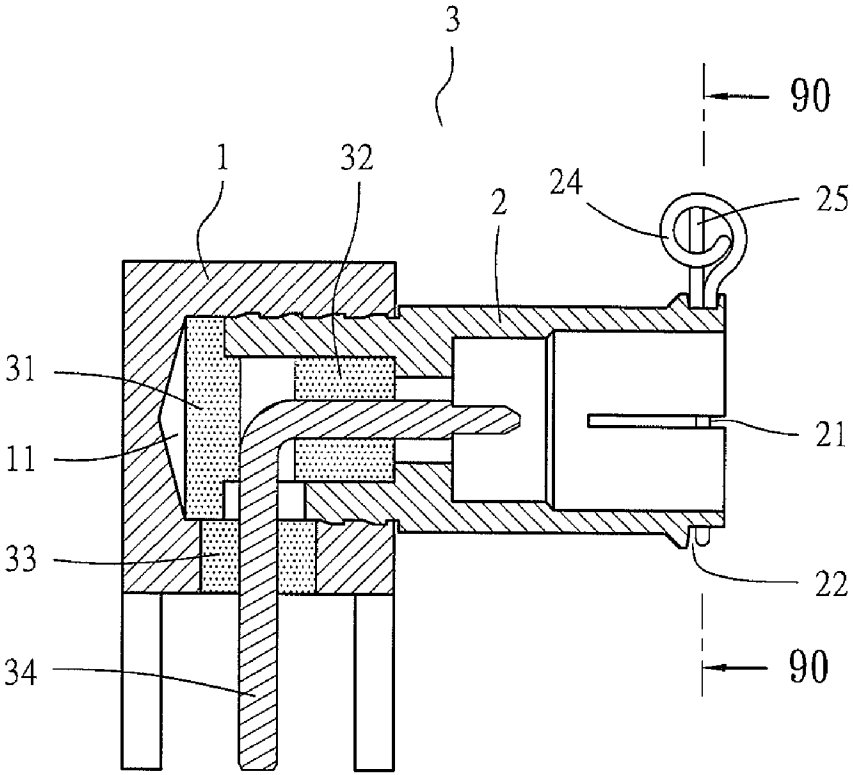
FIG. 9A is a front sectional view of the first component according to the present invention.

The first component 3 includes a connector 1 having a lateral side formed with a receiving hole 11. An adapter 2 is snugly inserted in the receiving hole 11, as shown in FIG. 9A and FIG. 9B, and has a bottom formed as a flat surface 26. The adapter 2 further has a connecting section peripherally formed with a plurality of spaced slots 21, as shown more clearly in FIGS. 8A, 8B, and 8C. In addition, at least one non-annular fastener 23 is mounted around a space 22 peripherally provided on the connecting section of the adapter 2, as shown in FIGS. 9A and 9B. The non-annular fastener 23 has two ends which jointly form an opening and which are each formed with a loop 24, 25. The loops 24 and 25 in the present embodiment are axially and radially oriented, respectively. The flat surface 26 serves to prevent the non-annular fastener 23 from rotating. When the adapter 2 is inserted into the connector 1, a plurality of insulators 31, 32, 33 are also placed at predetermined positions to allow an L-shaped pin 34 to be stably inserted through the connector 1 and the adapter 2. Thus, the first component 3 is completed.

Figure 1:
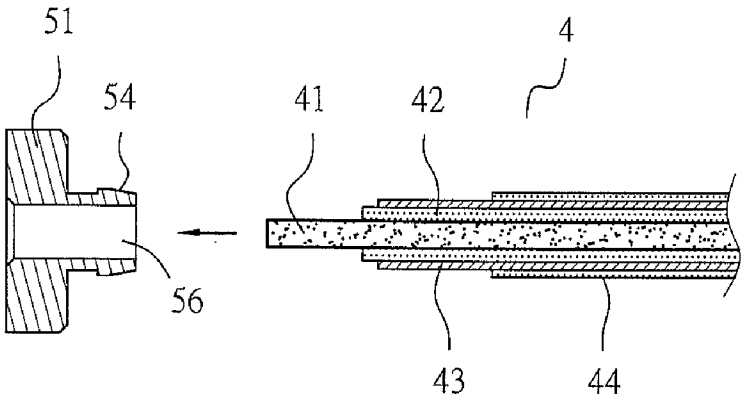
FIG. 1 is a sectional view showing assembly of a second component according to the present invention.
Figure 2:
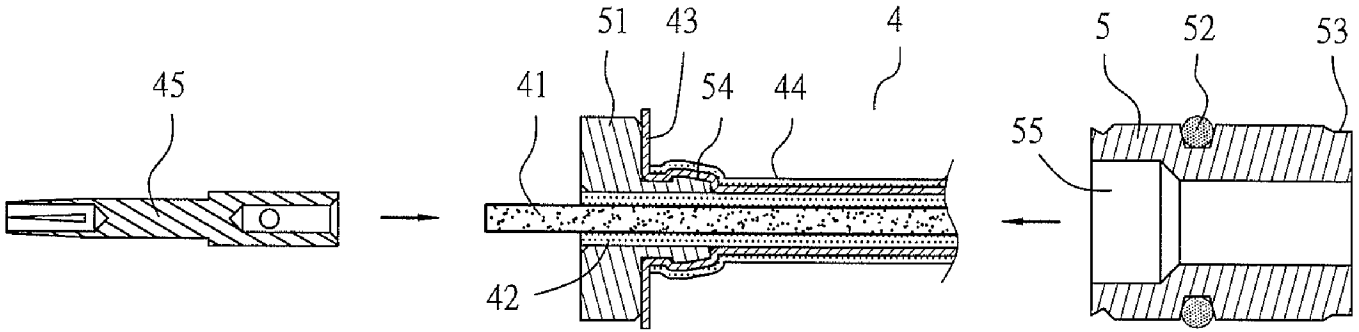
FIG. 2 is another sectional view showing assembly of the second component according to the present invention.
Figure 3:
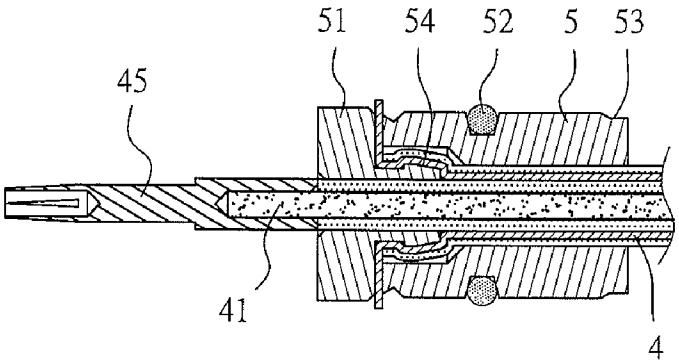
FIG. 3 is yet another sectional view showing assembly of the second component according to the present invention.
Figure 4:
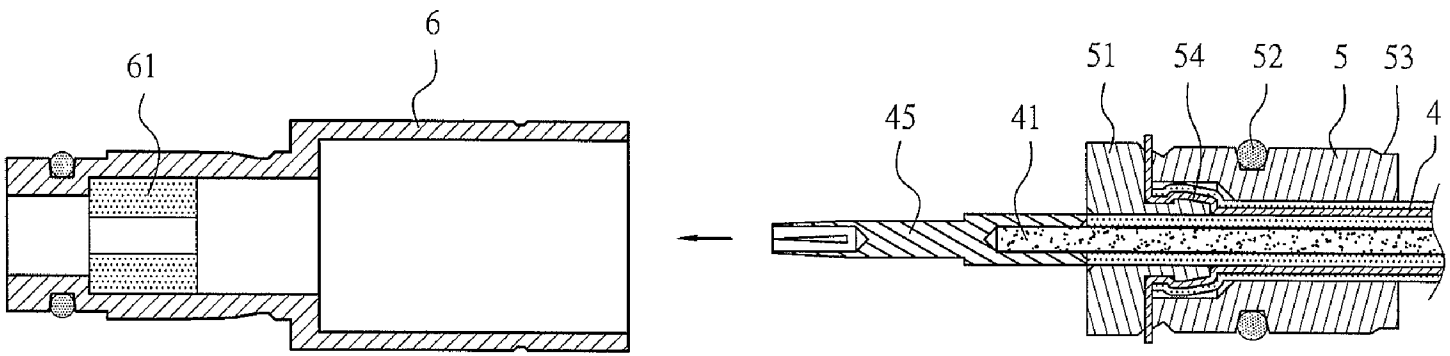
FIG. 4 is a further sectional view showing assembly of the second component according to the present invention.
Figure 5:
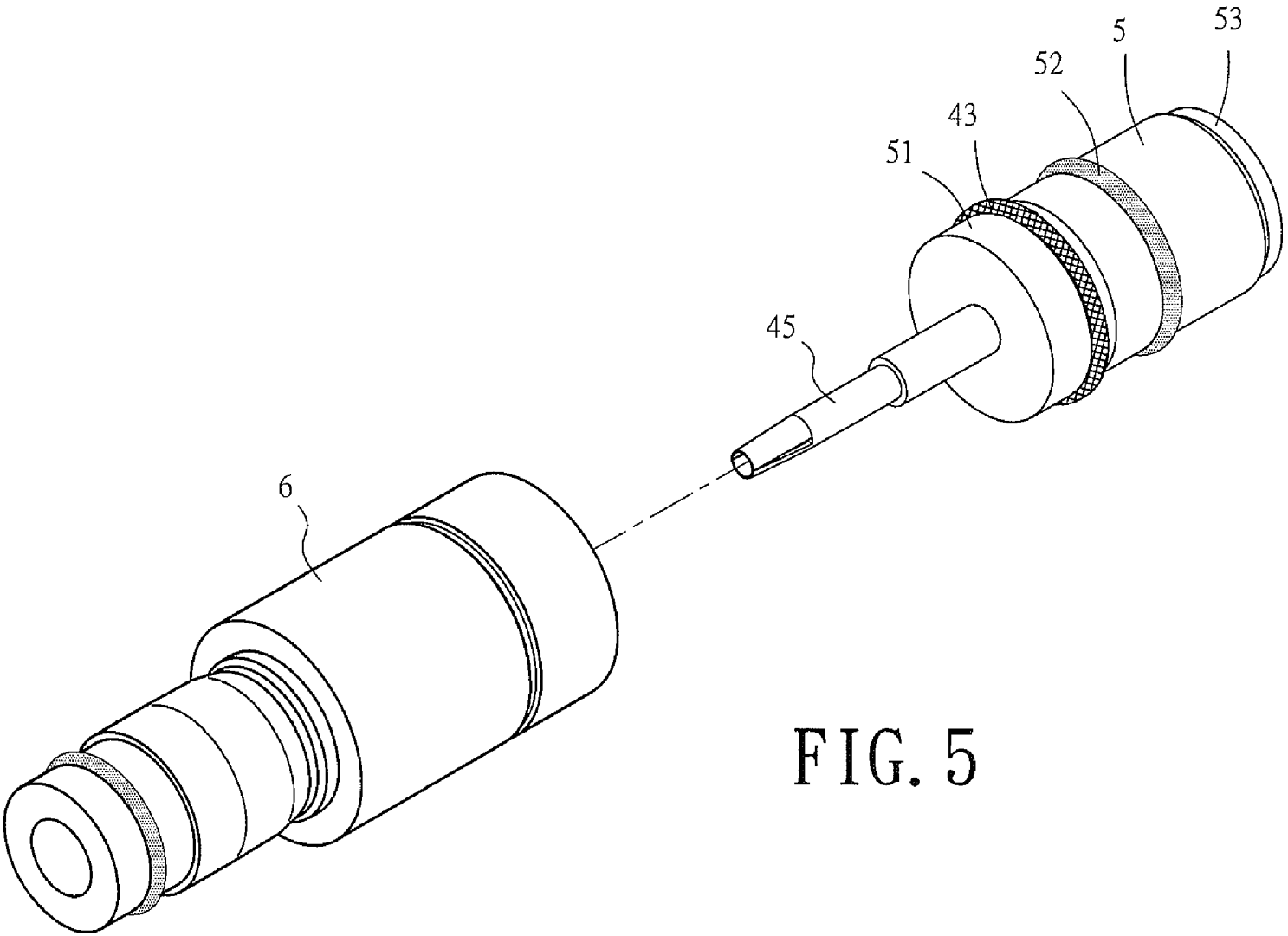
FIG. 5 is a perspective view showing assembly of the second component according to the present invention.
Figure 6:
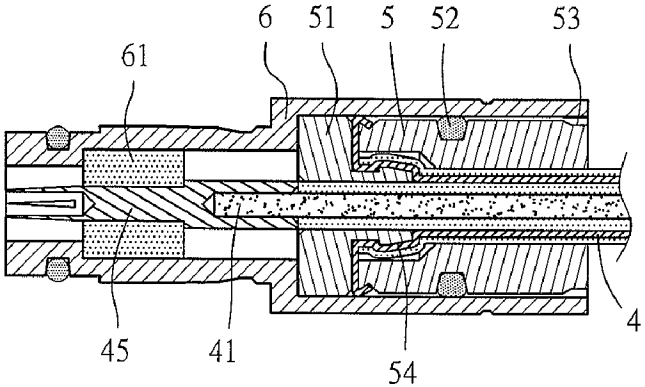
FIG. 6 is another sectional view showing assembly of the second component according to the present invention.
Figure 7:
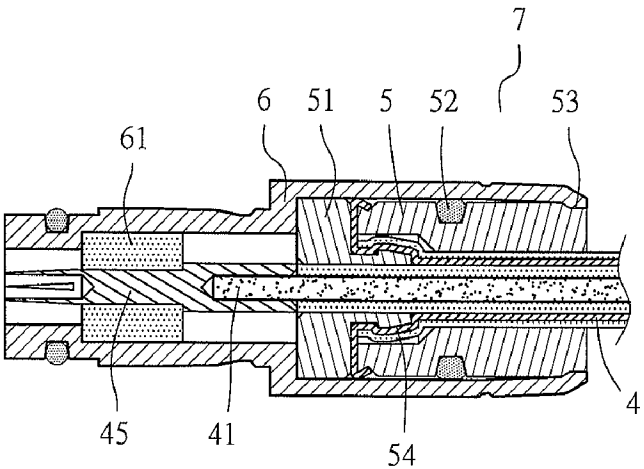
FIG. 7 is a front sectional view of the second component according to the present invention.

The second component 7 includes a coaxial cable 4. The coaxial cable 4 is composed of an inner conductor 41 sequentially wrapped by an insulator 42, an outer conductor 43, and a plastic jacket 44, as shown in FIG. 1. At an end of the coaxial cable 4 from which the inner conductor 41 protrudes, a dielectric spacer 51 is fitted around the outer periphery of the insulator 42 such that the outer conductor 43 and the plastic jacket 44 wrap conformally around an end of the dielectric spacer 51, as shown in FIG. 2. Then, the inner conductor 41 protruding from the end of the coaxial cable 4 that is connected with the dielectric spacer 51 is bonded to a conduction element 45, while the opposite end of the coaxial cable 4 is inserted through an inner bore 55 of an inner copper tube 5, as shown in FIG. 3. Consequently, the plastic jacket 44 and the outer conductor 43 of the coaxial cable 4 each have a portion located between a pressing ring 54 of the dielectric spacer 51 and the inner bore 55 of the inner copper tube 5 and wrapping around the pressing ring 54 so as to provide moisture resistance. Furthermore, at least one watertight O-ring 52 is provided around the outer periphery of a predetermined section of the inner copper tube 5 whose inner bore 55 is penetrated by the coaxial cable 4. Also, the inner copper tube 5 has an outer end peripherally and concavely provided with an annular recess 53. The coaxial cable 4, together with the inner copper tube 5 and the dielectric spacer 51 coupled respectively to the coaxial cable 4 from the opposite ends thereof, is further inserted in a connecting element 6, as shown in FIG. 4 and FIG. 5, such that the conduction element 45 bonded to the inner conductor 41 passes through a Teflon insulator 61 provided at an inner bore of the connecting element 6, as shown in FIG. 6. The connecting element 6 surrounding the inner copper tube 5 and the dielectric spacer 51, which are penetrated by the coaxial cable 4, has an end corresponding in position to the annular recess 53 formed at the outer end of the inner copper tube 5, and this end of the connecting element 6 is pressed inward against the annular recess 53, as shown in FIG. 7, thus completing the second component 7 while providing further moisture resistance to the coaxial cable 4 passing through the second component 7.

Figure 14:
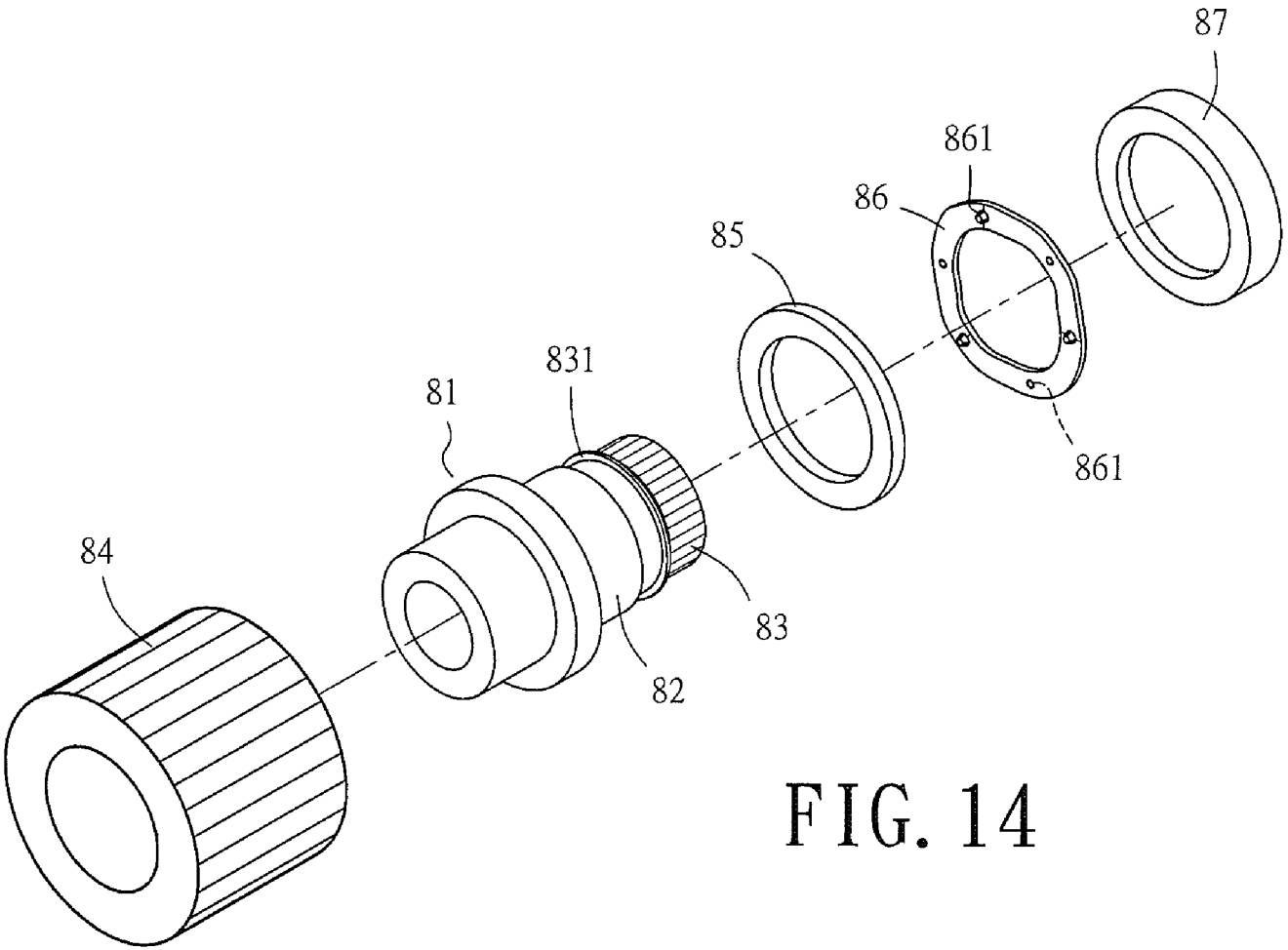
FIG. 14 is an exploded perspective view of certain elements of an antenna according to the present invention.

The antenna 8 includes a dielectric spacer 81 which is externally mounted with a coupling element 84 and has an end formed as a shaft 82. As shown in FIG. 14 and FIG. 15, a plastic washer 85, a wave washer 86, and a positioning washer 87 are sequentially mounted around the shaft 82. The wave washer 86 sandwiched between the plastic washer 85 and the positioning washer 87 has opposite surfaces alternately formed with a plurality of projections 861, as shown in FIG. 14. Thus, the projections 861 on each surface of the wave washer 86 provide frictional resistance against the contact surface of the adjacent plastic washer 85 or of the adjacent positioning washer 87 to prevent the plastic washer 85 from deformation which may otherwise result from rotation of the antenna 8. In addition, the wave washer 86 itself is prevented from displacement when the antenna 8 is rotated. Consequently, the entire assembled antenna 8 can remain in a stable assembled state in a fine-tuning operation. Moreover, the dielectric spacer 81 penetrated by the coaxial cable 4 has an inner section formed as an embossed connecting rod section 83. The connecting rod section 83 is provided with at least one chamfered flange 831 for tightly restraining the antenna 8 after the antenna 8 is coupled to the dielectric spacer 81.

Figure 10:
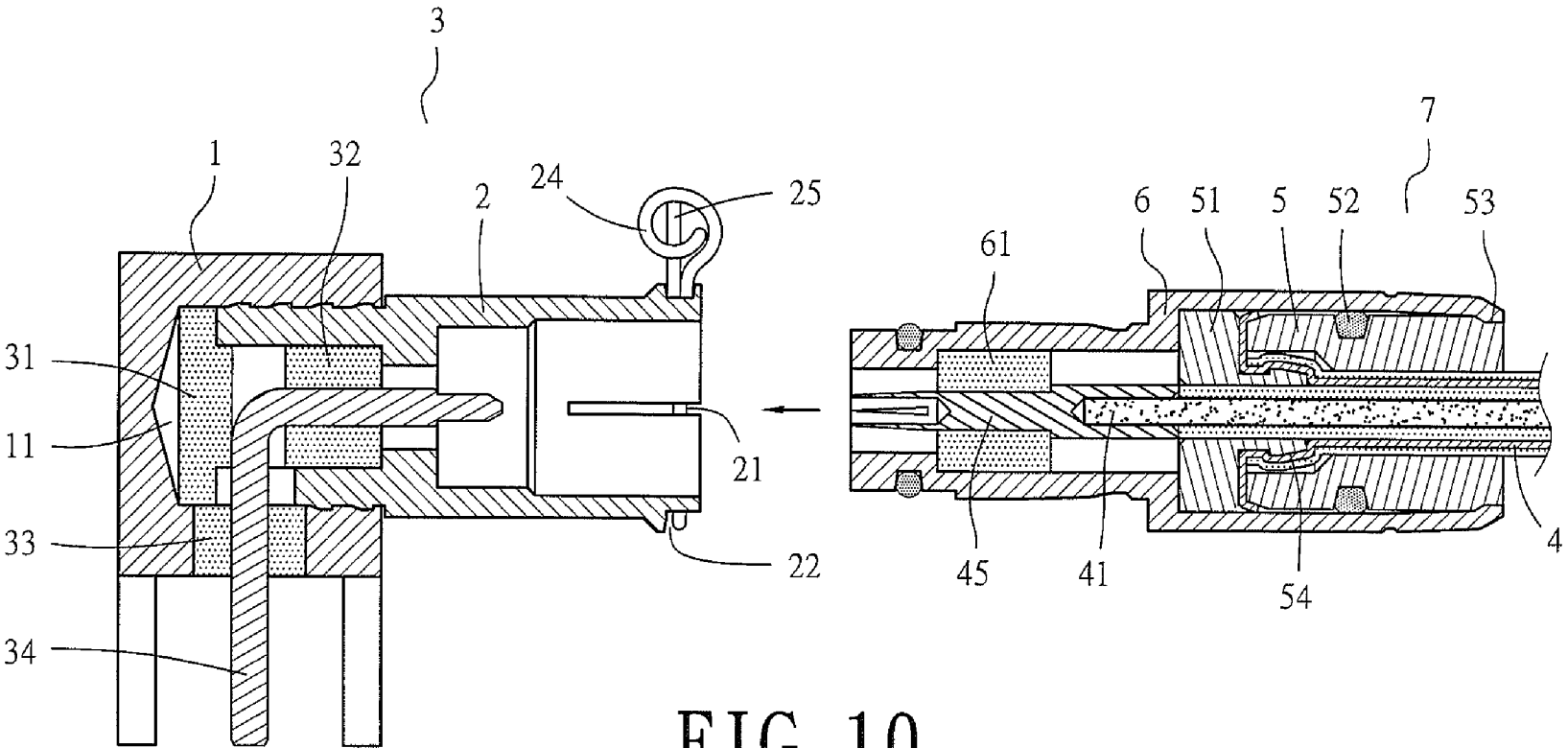
FIG. 10 is a front sectional view of the first and second components according to the present invention in an unassembled state.
Figure 11:
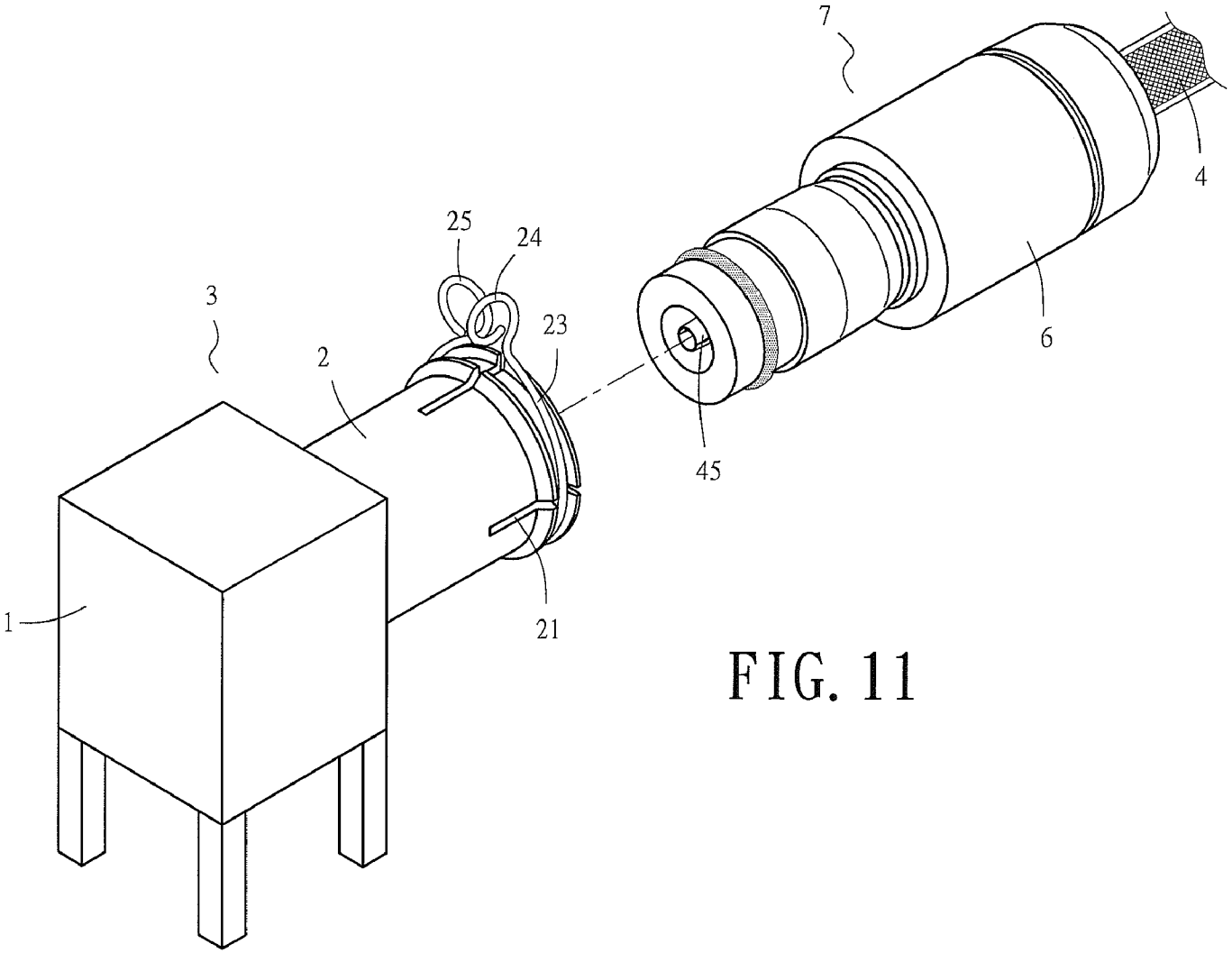
FIG. 11 is a perspective view of the first and second components according to the present invention in the unassembled state.
Figure 12B:
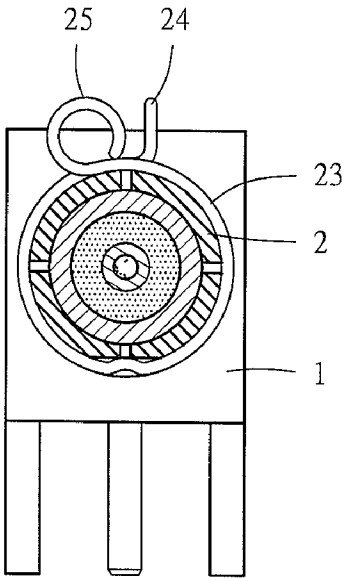
FIG. 12B is a sectional view taken along line 120-120 of FIG. 12A.
Figure 12A:
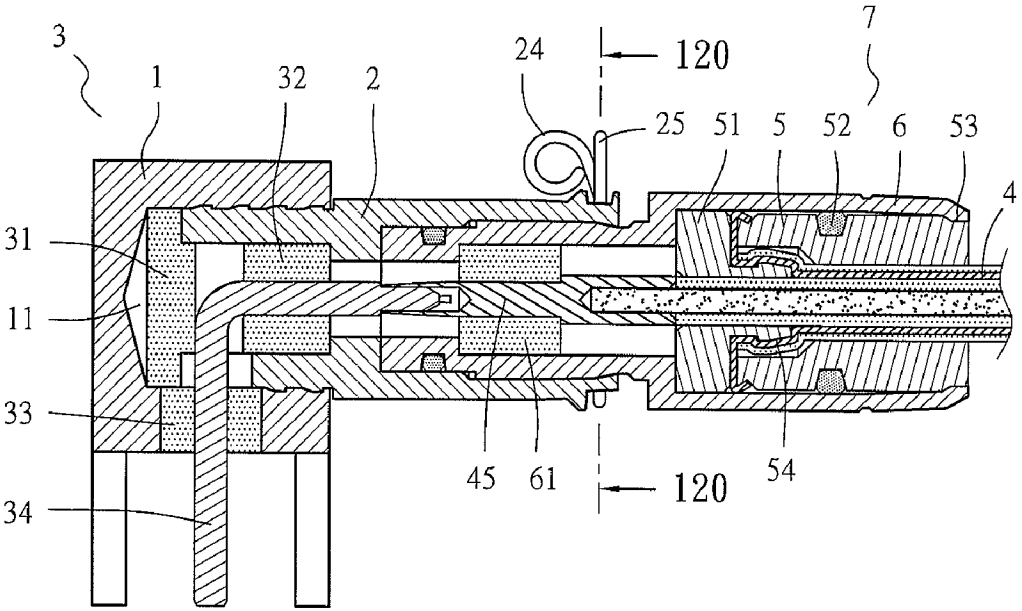
FIG. 12A is a front sectional view of the first and second components according to the present invention in an assembled state.
Figure 13:
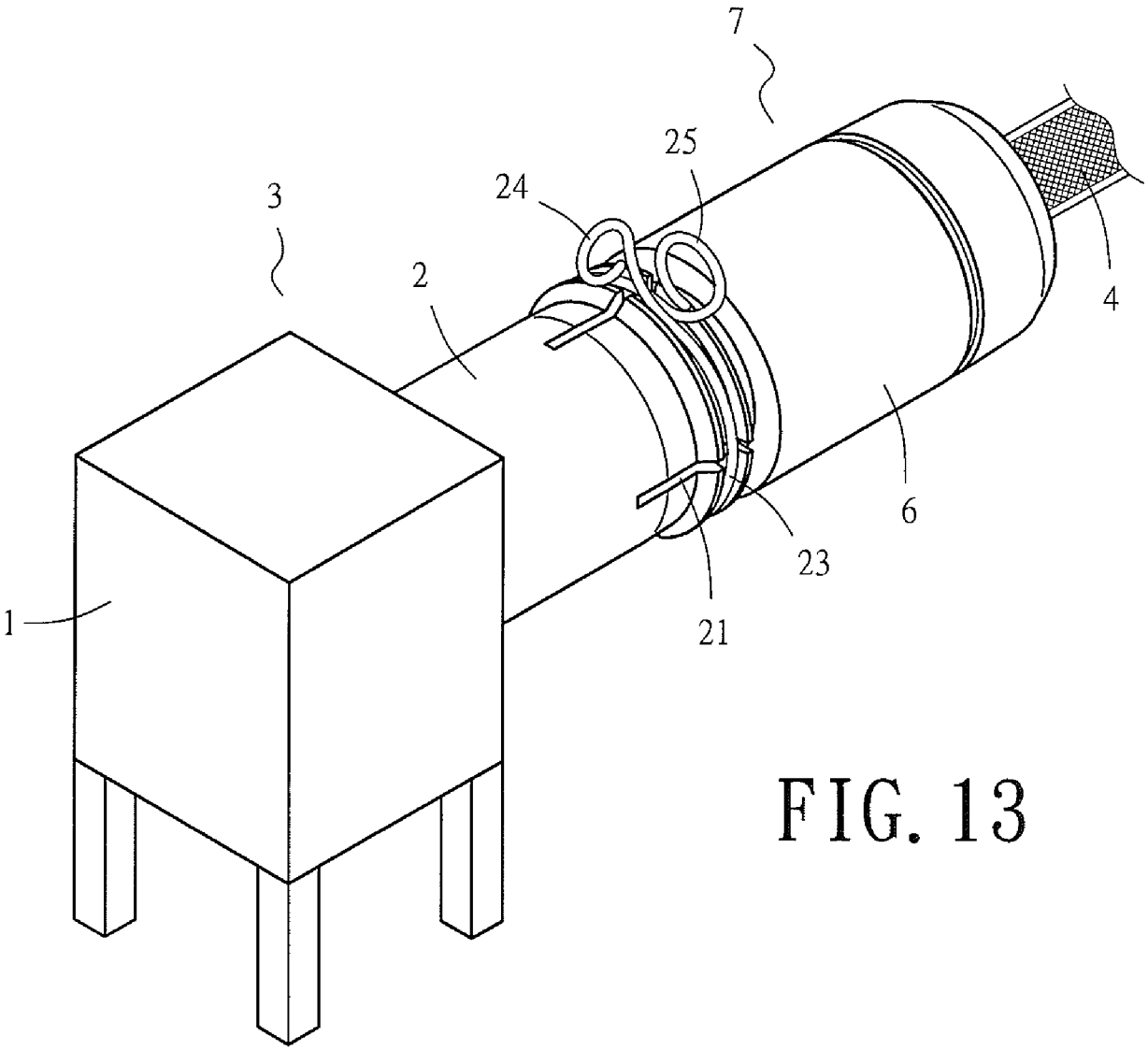
FIG. 13 is a perspective view of the first and second components according to the present invention in the assembled state.

Assembly of the first component 3 and the second component 7 is described hereinafter with reference to FIG. 10 and FIG. 11. The second component 7 is inserted into the adapter 2 at an end of the first component 3 such that the conduction element 45 at an end of the second component 7 mates with the L-shaped pin 34 of the first component 3, as shown more clearly in FIG. 12A and FIG. 12B. Then, the at least one non-annular fastener 23 at the end of the first component 3 is fastened, as shown in FIG. 13, so as to provide moisture and shock resistance between the two components. A screw passing through the loops 24, 25 at the two ends of the non-annular fastener 23 can be used to fix or attach the loops 24, to a car, a television set, a base station, and so on which are subject to external shock and moisture, thereby preventing the non-annular fastener 23 from falling off or the connector assembly 9 from getting damp during use, with a view to ensuring signal transmission quality.

After the first and second components 3, 7 are put together, the antenna 8, which is also penetrated by the coaxial cable 4, is coupled to the assembled first and second components 3, 7 to complete the connector assembly 9, as shown in FIG. 16. The connector assembly 9 can be installed in a car and used for signal relay and transmission in wideband wireless communication while providing excellent resistance to shock and moisture. Furthermore, while the antenna 8 of the connector assembly 9 is being fine-tuned to a desired angle, displacement of the antenna 8 remains tightly restrained.

What is claimed is:

1. A shock- and moisture-resistant connector assembly, comprising a first component, a second component, and an antenna and characterized in that:

the first component has an end fitted with an adapter having a connecting section encircled by at least a non-annular fastener, each said non-annular fastener having two ends which jointly form an opening and are each formed with a loop having a different orientation, wherein the two loops of each said non-annular fastener can be pulled outward away from each other such that each said non-annular fastener is pulled open and has an increased outer diameter, thus allowing each said non-annular fastener to be mounted around the connecting section of the adapter at the end of the first component;

wherein after the connecting section of the adapter is connected with the second component, the loops at the two ends of each said non-annular fastener encircling a border portion between the first component and the second component can be twisted around each other, thus providing secure fastening as well as resistance to moisture and shock; and wherein the loops at the two ends of each said non-annular fastener can be fixed or attached, by a screw passing through the loops, to a car, a television set, or a base station which are subject to shock and moisture.

2. The shock- and moisture-resistant connector assembly of claim 1, wherein the loops at the two ends of each said non-annular fastener encircling the connecting section of the adapter at the end of the first component are axially and radially oriented, respectively.

3. A shock- and moisture-resistant connector assembly, comprising a first component, a second component, and an antenna and characterized in that:

the antenna comprises a dielectric spacer externally mounted with a coupling element and having an end formed as a shaft, around which a plastic washer, a wave washer, and a positioning washer are sequentially mounted, wherein the wave washer sandwiched between the plastic washer and the positioning washer has opposite surfaces alternately formed with a plurality of projections such that the projections on each said surface of the wave washer provide frictional resistance against a contact surface of the adjacent plastic washer or of the adjacent positioning washer, thus tightly restraining displacement of the entire assembled antenna during a fine-tuning operation.

4. A shock- and moisture-resistant connector assembly, comprising a first component, a second component, and an antenna and characterized in that the second component is provided therein sequentially with:

a connecting element having a hollow interior for receiving a conduction element, a dielectric spacer, a coaxial cable, and an inner copper tube;

the conduction element bonded to an inner conductor of the coaxial cable;

the dielectric spacer having an outer periphery provided with a pressing ring;

the coaxial cable composed of the inner conductor, an insulator, an outer conductor, and a plastic jacket; and the inner copper tube having a hollow interior for receiving the coaxial cable passing therethrough and an outer periphery provided with an O-ring and an annular recess;

wherein the inner conductor and the insulator of the coaxial cable are inserted in an inner bore of the dielectric spacer, thus forcing the pressing ring of the dielectric spacer to push away the outer conductor and the plastic jacket of the coaxial cable, such that after the dielectric spacer and the coaxial cable enter an inner bore of the inner copper tube, a portion of the outer conductor and a portion of the plastic jacket that are interposed between the dielectric spacer and the inner copper tube provide moisture resistance; and wherein after the inner copper tube is inserted in the connecting element, a portion of the connecting element that corresponds in position to the annular recess of the inner copper tube is pressed by an external force against the annular recess such that the O-ring provides further moisture resistance.

* * * * *